US005096170A

United States Patent [19]

Albin

[11] Patent Number: 5,096,170

[45] Date of Patent: Mar. 17, 1992

[54] CLAMP FOR PICTURE FRAME TOOL AND OTHER PURPOSES

[76] Inventor: Stephen D. Albin, 797 Manor Way, Los Altos, Calif. 94022

[21] Appl. No.: 698,370

[22] Filed: May 9, 1991

Related U.S. Application Data

[63] Continuation of Ser. No. 572,510, Aug. 23, 1990, abandoned.

[51] Int. Cl.[5] ..... B25B 1/24

[52] U.S. Cl. ..... 269/6; 269/203; 269/282

[58] Field of Search ..... 269/6, 203, 279-284, 269/54.2, 258-263, 274, 285; 227/140-148

[56] References Cited

U.S. PATENT DOCUMENTS

| | | | |
|---|---|---|---|
| 669,282 | 3/1901 | Lanpher | 269/203 |
| 949,096 | 2/1910 | Stetson | 269/282 |
| 956,128 | 4/1910 | Mimmack | 81/362 |
| 1,385,506 | 7/1921 | Taylor | 81/126 |
| 1,498,638 | 6/1924 | Periolat | 269/282 |
| 2,432,352 | 12/1947 | Strotz | 269/282 |
| 2,889,730 | 7/1959 | Reiniger | 81/362 |
| 4,253,648 | 3/1981 | Meeks | 269/203 |
| 4,537,099 | 8/1985 | Oster et al. | 81/355 |
| 4,763,825 | 8/1988 | Albin . | |
| 4,834,352 | 5/1989 | Thornton | 269/303 |
| 4,926,722 | 5/1990 | Sorensen et al. | 269/6 |

*Primary Examiner*—Robert C. Watson
*Attorney, Agent, or Firm*—Julian Caplan

[57] ABSTRACT

A picture framer's tool of the type used to drive brads into picture frames shown in U.S. Pat. No. 4,763,825 is modified so that it may also be used as a clamp. The tool has two jaws, namely an inner adjustably positioned along a sleeve and a second jaw on the outer end of a rod reciprocable within the sleeve and extending beyond the outer end of said sleeve. The tool has a lever pivoted on a handle which causes the rod to reciprocate. One improvement is the provision of a wing screw or other fastener on the handle which engages the rod so that it is fixed in position. Another improvement is the provision of attachments for each jaw, one of which may be spring-loaded. Attachments include hammer heads, points, swivels and the like.

3 Claims, 2 Drawing Sheets

CLAMP FOR PICTURE FRAME TOOL AND OTHER PURPOSES

This is a continuation of application Ser. No. 07/572,510 filed Aug. 23, 1990 now abandoned.

BACKGROUND OF THE INVENTION

1. Field of the Invention

This invention relates to a new and improved clamp for picture frame tools and for other purposes. More particularly, the invention is an improvement on a picture framer's tool such as shown in applicant's prior U.S. Pat. No. 4,763,825 which is used to drive brads, staples, points or other fasteners into the inner edge of the backing of a picture frame to secure material in the frame. The invention provides means whereby the opposed jaws of such a tool may be clamped in position relative to each other to function as a clamp to hold workpieces together.

2. Prior Art

As has been stated, much of the structure of the invention is used in the picture framer's tool hereinbefore described. C-clamps have been generally used in carpentry and metal working for many years. The present invention permits a framer's tool to function as a C-clamp by adjustably locking the jaws of the framing tool relative to each other.

SUMMARY OF THE INVENTION

The tool of the present invention has a handle having pivoted thereto a finger grip which causes a rod extending out beyond the end of sleeves to reciprocate which extends from the handle. The inner jaw of the clamp is adjustable along the length of the sleeve. The outer jaw is fixed to the outer end of the rod so that the outer jaw reciprocates with the rod as the finger grip is actuated.

A retainer on the handle of the tool is provided to hold the rod in fixed position within the handle. A preferred retainer is a wing nut threaded into the handle which engages the rod. Preferably a second wing nut opposite the first engages the opposite side of the rod to prevent the rod from being bent when the first-mentioned wing nut is tightened.

Still another feature of the invention is that one jaw may have a spring biased fitting to facilitate clamping action. Such a fitting may be pointed or flat. The opposite jaw may have similar fittings or may be provided with a swiveled base. A rubber or plastic pad may be placed on or over one or both jaws.

BRIEF DESCRIPTION OF THE DRAWINGS

The accompanying drawings, which are incorporated in and form a part of this specification, illustrate embodiments of the invention and, together with the description, serve to explain the principles of the invention.

DETAILED DESCRIPTION OF THE PREFERRED EMBODIMENT

Figure 1:
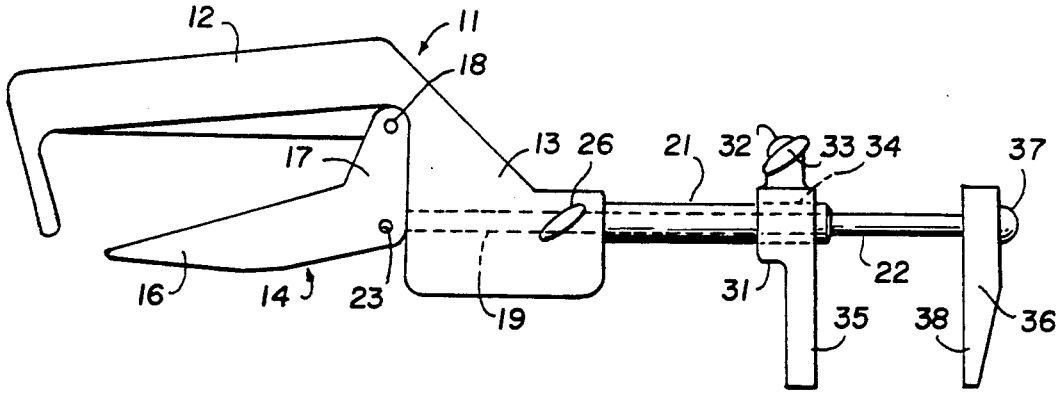
FIG. 1 is a side elevational view of the device shown in open position.
Figure 2:
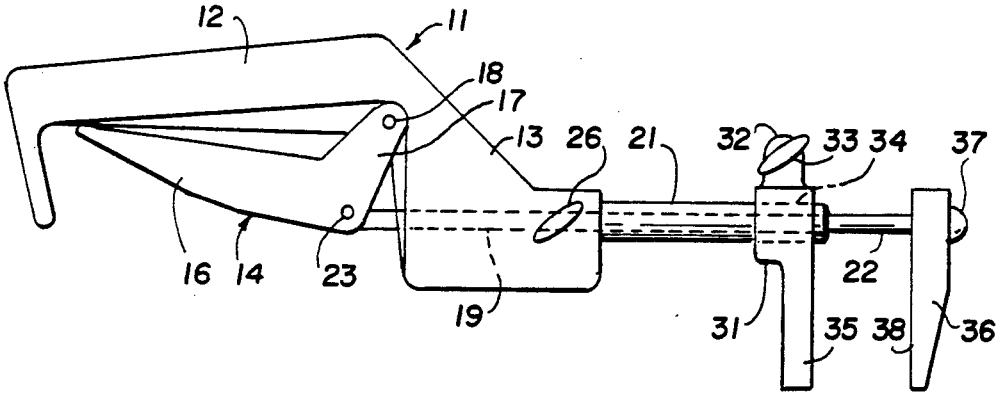
FIG. 2 is a view similar to FIG. 1 showing the device partially closed.
Figure 3:
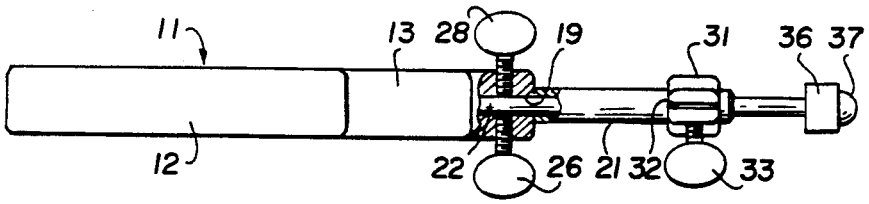
FIG. 3 is a top plan view of the structure of FIGS. 1 or 2, partly broken away to reveal internal construction.
Figure 4:
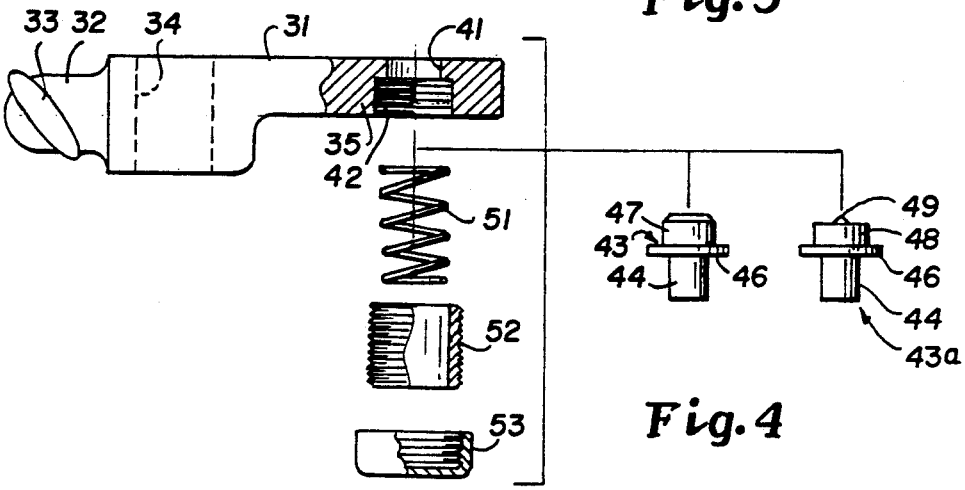
FIG. 4 is a schematic exploded elevational view of the inner jaw of the tool and various fittings which may be used therewith, partially broken away in section.

Reference will now be made in detail to the preferred embodiments of the invention, examples of which are illustrated in the accompanying drawings. While the invention will be described in conjunction with the preferred embodiments, it will be understood that they are not intended to limit the invention to those embodiments. On the contrary, the invention is intended to cover alternatives, modifications and equivalents, which may be included within the spirit and scope of the invention as defined by the appended claims.

The tool has a handle 11 having a hand grip 12 which fits into the palm of the user with an offset 13 extending approximately perpendicular thereto. A bell crank shaped lever 14 has one arm 16 constituting a finger grip and a second arm 17 which is pivoted at its outer end by means of pivot 18 to a portion of handle 11. Offset 13 is formed with a bore 19 and has a sleeve 21 projecting in alignment therewith. Reciprocal within sleeve 21 and bore 19 is a rod 22 the inner end of which is pivoted by means of pivot 23 to the mid-point of lever 14. Since the bore 19 is somewhat oversize and the pivot 23 extends through an oversized hole (not shown) in the proximal end of rod 22, squeezing the finger grip 16 toward the grip 12 causes the rod to reciprocate within the bore 19 without binding. This portion of the device is essentially that shown in U.S. Pat. No. 4,763,825.

In the present invention, a wing screw 26 is threaded into offset 13 in alignment with bore 19. The inner end of screw 26 bears against rod 22. When the inner end of the screw 26 engages the flat, movement of rod 22 within the bore 19 is prevented. To prevent the pressure of the screw 26 from bending or distorting the rod 22, a second wing screw 28 may be threaded into the offset 13 from the opposite side. The forces of the two screws 26,28 balance each other.

Movable along sleeve 21 is inner jaw 31 which has a split end 32. Wing screw 33 passes through one of the split ends 32 and is threaded into the opposite end. By tightening screw 33, the split 32 is drawn together clamping the bore 34 of jaw 31 into a preselected position along sleeve 21. Anvil 35 of jaw 31 preferably extends perpendicular to the axis of sleeve 21.

Second jaw 36 is secured to the outer end of rod 22. For such purpose a screw 37 is threaded through the inner end of jaw 36 and extends into a threaded hole (not shown) on the outer end of rod 22. The anvil 38 extends opposed to anvil 35.

In use as a framing tool, the anvils 35,38 are placed on opposite sides of one of the members of a frame and a brad, staple or point or other fastener is positioned against one of the jaws. Indeed, a stapler tool may be incorporated on one of the jaws. When the finger grip 16 is pressed toward the handle 11, the jaws 35,38 come together and force the fastener into the inner edge of the frame member. In the use of the device as a clamp, the jaws 35,38 are brought into juxtaposition to the parts to be clamped and then the grip 16 is pulled toward the grip 12 until the parts are clamped together whereupon the screws 26,28 are tightened, locking the parts together.

Figure 5:
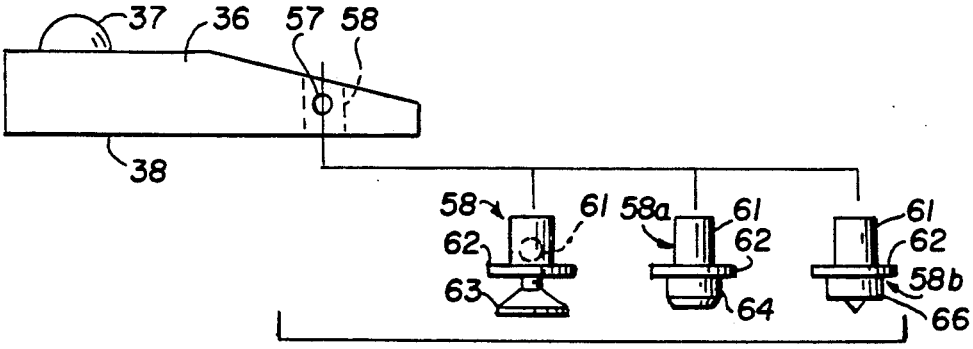
FIG. 5 is a side elevational view of the outer jaw and shows the various fittings which may be used therewith.

Directing attention to FIG. 5, a modified clamp 31 is formed with a hole 41 extending transversely through the anvil 35. A counter bored hole 42 is formed on the opposite side of the jaw. Various types of fittings 43, 43*a*, etc. may be inserted in the hole 41. Thus the fitting 43 has a head 47 which may be of solid steel or plastic may have plastic, felt, leather or other facing material. Behind the head 47 is a collar 46 which is smaller than the hole 42 but larger than the hole 41. Hence when the head 47 is inserted through the hole 42 the collar 46 fits against the base of the hole 42 and the head 47 projects out through the hole 41. The fitting 43*a* differs from fitting 43 in that a point 49 is formed therein for better gripping of material to be clamped or to form a hole or dimple in material being clamped. The fittings 43,43*a* may be interfitted. They are held in position by spring 51 which fits against the back of the collar 46 and within an externally threaded sleeve 52 which is threaded into the bore 42. Nut 53 on the outer end of sleeve 52 secures the parts in place. When it is necessary to change a part, the nut 53 is removed and the spring 51 and fitting 43 drop out, whereupon a different fitting may be inserted.

Figure 6:
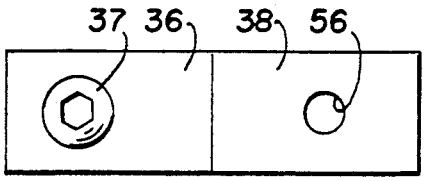
FIG. 6 is a top plan view of the structure of FIG. 5.
Figure 7:
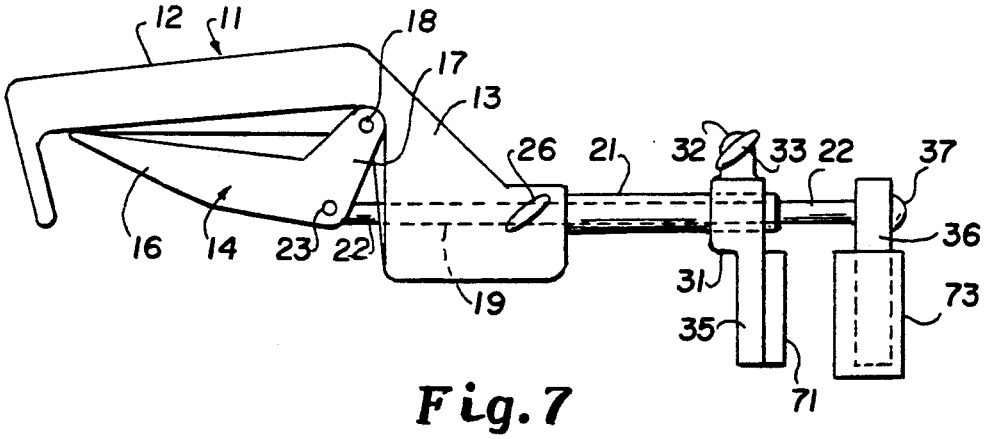
FIG. 7 is a view similar to FIG. 2 modification.
Figure 8:
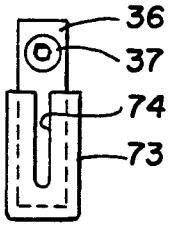
FIG. 8 is a side elevation of the structure of FIG. 7.

FIGS. 6 and 7 show the outer jaw 36. In the modification of FIGS. 6 and 7, a hole 56 is formed in the anvil 38 and a set screw 57 is threaded transversely thereinto. Fittings 58,58*a*,58*b*, etc. may be inserted in the hole 56. Thus each fitting has a shank 61 shaped to fit inside the hole 56 and a collar 62 to bear against the inner face of the anvil 38. The fitting 58 has a swivel 56 on its inner end which may be used to clamp against material which is not parallel to the anvil 38. The fitting 58*a* has a head 64 similar to the head 43. The fitting 58*b* is similar to the fitting 43*a*.

FIG. 7 shows a further modified clamp. Anvil 35 of inner jaw 31 is provided with a pad 71 adhered thereto. Pad 71 may be of rubber or other resilient material. Anvil 38 of outer jaw 36 may be provided with a removable resilient cover 73. Cover 73 is formed with a split 74 on its side to facilitate slipping the cover on or off the anvil.

It will be understood that if the device is to be used as a clamp, the anvils 35,38 may be used or if it is desired, different fittings 58,58*a*,58*b*,43,43*a*, may be installed prior to the clamping action. Further, to prevent damage to the object being clamped, pad 71 or cover 73 may be used.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated. It is intended that the scope of the invention be defined by the claims appended hereto and their equivalents.

What is claimed is:

1. A combination picture framing and clamp tool comprising a handle fixed to a sleeve extending therefrom, said handle being formed with a bore aligned with said sleeve, a rod reciprocable in said bore and sleeve and extending out beyond said sleeve, manually operable means on said handle to cause reciprocation of said rod within said sleeve and bore to cause movement of said rod toward and away from said handle in minute increments, a normally fixed first jaw on said sleeve, a movable second jaw on said rod opposed to said first jaw, and rod restraining means on said handle to engage said rod to restrain movement of said rod relative to said handle at any position of adjustment of said second jaw relative to said first jaw, said restraining means comprising a first screw threaded into said handle and bearing against said rod at a first position and a second screw threaded into said handle and bearing against said rod at a second position opposite said first position.

2. A tool according to claim 1 in which said first jaw is adjustably positionable along said sleeve.

3. A combined picture framing and clamp tool comprising a handle fixed to a sleeve extending therefrom, said handle being formed with a bore aligned with said sleeve a rod reciprocable in said bore and sleeve and extending out beyond said sleeve, manually operable means on said handle to cause reciprocation of said rod within said sleeve and bore to cause movement of said rod toward and away from said handle in minute increments, a normally fixed first jaw on said sleeve, a movable second jaw on said rod opposed to said first jaw, and rod restraining means on said handle to engage said rod to restrain movement of said rod relative to said handle at any position of adjustment of said second jaw relative to said first jaw, in which said first and second jaws are formed with opposed outward extending anvils, at least one said anvil being formed with a hole and which further comprises a plurality of fittings selectively positionable in said hole and means to secure one of said fittings in said hole, said hole being formed with a threaded counterbore, said fitting comprising a head extendable through said second hole, a collar behind said head to engage the bottom of said counterbore and a shank on the end of said fitting opposite said head, said last-mentioned means comprising a threaded second sleeve threaded into said counterbore, a spring, and a nut on the outer end of said second sleeve, said spring bearing against said nut and said shank to resiliently bias said head outward of said jaw.

* * * * *